US011534370B2

(12) United States Patent
Harada et al.

(10) Patent No.: US 11,534,370 B2
(45) Date of Patent: Dec. 27, 2022

(54) DRUG-FILLED SYNTHETIC RESIN AMPULE AND SYNTHETIC RESIN AMPULE BODY USED FOR SAME

(71) Applicant: TERUMO KABUSHIKI KAISHA, Tokyo (JP)

(72) Inventors: Naomi Harada, Hadano (JP); Akira Chiba, Fujinomiya (JP); Masahide Yamagami, Atsugi (JP); Taeko Masuda, Hadano (JP)

(73) Assignee: TERUMO KABUSHIKI KAISHA, Tokyo (JP)

( * ) Notice: Subject to any disclaimer, the term of this patent is extended or adjusted under 35 U.S.C. 154(b) by 169 days.

(21) Appl. No.: 17/028,311

(22) Filed: Sep. 22, 2020

(65) Prior Publication Data

US 2021/0000689 A1 Jan. 7, 2021

Related U.S. Application Data

(63) Continuation of application No. PCT/JP2019/011582, filed on Mar. 19, 2019.

(30) Foreign Application Priority Data

Mar. 23, 2018 (JP) ..... JP2018-056496

(51) Int. Cl.
*A61J 1/06* (2006.01)
*A61J 1/14* (2006.01)

(52) U.S. Cl.
CPC ..... *A61J 1/065* (2013.01); *A61J 1/1406* (2013.01)

(58) Field of Classification Search
CPC ..... A61J 1/065; A61J 1/067; A61J 1/1406
See application file for complete search history.

(56) References Cited

U.S. PATENT DOCUMENTS 4,995,519 A * 2/1991 Rose ..... B65D 1/095 206/532
5,897,008 A * 4/1999 Hansen ..... A61J 1/065 215/48
7,032,590 B2 * 4/2006 Loeffler ..... A61M 15/009 206/532

(Continued)

FOREIGN PATENT DOCUMENTS

JP 2013095436 A 5/2013
JP 2014069856 A 4/2014

(Continued)

OTHER PUBLICATIONS

International Search Report (PCT/ISA/210) dated May 28, 2019, by the Japanese Patent Office as the International Searching Authority for International Application No. PCT/JP2019/011582.

(Continued)

*Primary Examiner* — Timothy L Maust
(74) *Attorney, Agent, or Firm* — Buchanan Ingersoll & Rooney PC

(57) ABSTRACT

A drug-filled synthetic resin ampule includes an ampule body and a drug 8 filled in the ampule body. The ampule body includes a tip-side sealing portion, a hollow portion, and an annular breakable portion provided between the tip-side sealing portion and the hollow portion. The tip-side sealing portion includes a flat plate portion for grasping formed at an upper portion thereof, and an internal ceiling portion exposed to the interior of the hollow portion. The breakable portion includes an annular smallest diameter portion, and the smallest diameter portion is located near an annular circumferential edge portion of the internal ceiling portion and is located above the annular circumferential edge portion of the internal ceiling portion.

20 Claims, 11 Drawing Sheets

(56) References Cited

U.S. PATENT DOCUMENTS

| | | | | |
|---|---|---|---|---|
| 8,377,029 | B2 * | 2/2013 | Nagao | B65D 1/095 220/255 |
| 8,640,873 | B2 * | 2/2014 | Nakano | B65D 1/095 206/532 |
| 2013/0018329 | A1 * | 1/2013 | Mehta | A61M 3/0279 604/246 |
| 2014/0039444 | A1 * | 2/2014 | Togawa | A61J 1/067 604/403 |
| 2018/0303710 | A1 | 10/2018 | Yago et al. | |
| 2019/0015297 | A1 | 1/2019 | Harada et al. | |

FOREIGN PATENT DOCUMENTS

| | | | |
|---|---|---|---|
| KR | 20140022340 | A | 2/2014 |
| WO | 2017115752 | A1 | 7/2017 |
| WO | 2017159832 | A1 | 9/2017 |

OTHER PUBLICATIONS

Written Opinion (PCT/ISA/237) dated May 28, 2019, by the Japanese Patent Office as the International Searching Authority for International Application No. PCT/JP2019/011582.

The extended European Search Report dated Nov. 24, 2021, by the European Patent Office in corresponding European Patent Application No. 19772004.8-1113. (36 pages).

An English Translation of the Written Opinion of the International Search Authority (Form PCT/ISA/237) dated May 28, 2019, by the Japanese Patent Office in corresponding International Application No. PCT/JP2019/011582. (5 pages).

* cited by examiner

DRUG-FILLED SYNTHETIC RESIN AMPULE AND SYNTHETIC RESIN AMPULE BODY USED FOR SAME

TECHNICAL FIELD

The present invention relates to a drug-filled synthetic resin ampule which is opened by a breaking operation and to a synthetic resin ampule body used therein.

BACKGROUND ART

In recent years, in place of glass containers, synthetic resin ampules have been used as containers for containing drugs from the viewpoint of safety against breakage of a container as a result of falling, injury when a container is opened, generation of fragments, etc., as well as from the viewpoint of ease of handling.

A synthetic resin ampule is disclosed in Japanese Patent Application Laid-Open (kokai) No. 2014-69856 (Patent Document 1). The synthetic resin ampule container of Patent Document 1 includes a body portion (1) formed, by biaxial stretch blow molding, into the shape of a tube with a bottom and containing an internal solution (N), a head portion (6) which has the shape of a tube with a top and which is continuously provided to extend vertically from the upper end of the body portion (1), and a weakened portion (10) which is formed at the boundary between the body portion (1) and the head portion (6) and which is broken as a result of relative displacement of the body portion (1) and the head portion (6). A large number of longitudinal ribs (9) are provided on an inner circumferential surface portion (7) to which the peripheral edge of the lower end liquid surface (n1) of a residual internal solution (n) located within the head portion (6) adheres. The longitudinal ribs (9) are juxtaposed along the circumferential direction so as to form an uneven surface portion (8). The uneven surface portion (8) is formed by mixedly forming the longitudinal ribs (9) whose upper ends differ in height position.

Another synthetic resin ampule is disclosed in, for example, Japanese Patent Application Laid-Open (kokai) No. 2013-095436 (Patent Document 2). The synthetic resin ampule of Patent Document 2 is a plastic ampule 1 which includes an ampule body 3 having a spout 8, a stopper portion 5 which is communicatably connected to the ampule body 3 through a neck portion 4 formed along the spout 8, and a head portion 7 which is connected to the stopper portion 5 through a thin plate-shape edge portion 6 projecting outward from the stopper portion 5, wherein the head portion 7 has an arm plate 15 which is flat in a direction intersecting the edge portion 6. A user pinches the arm plate 15 with his/her fingers and pulls the arm plate 15 upward so as to bend the ampule at a position between the ampule body 3 and the head portion 7, while using the neck portion 4 as a fulcrum, thereby cutting and breaking the neck portion 4 to open the ampule.

Also, the applicant of the present application has proposed another synthetic resin ampule disclosed in, for example, WO2017/159832 (Patent Document 3). The synthetic resin ampule of Patent Document 3 includes an ampule body 2*m* and a drug 6 filled in the ampule body 2*m*. The ampule body 2*m* has a tip portion 3, a hollow portion 21 having a drug containing portion 23, and an annular breakable portion 5 provided between a lower portion of the tip portion 3 and an upper portion of the hollow portion 21. The ampule body includes no inner surface protrusion on an inside portion thereof which is located on a side toward the tip portion with respect to the breakable portion. The tip portion is configured such that an inner top surface of the tip portion is located near a plane defined by the annular breakable portion and an inner surface of the tip portion is a low-drug-retention surface.

Also, the applicant of the present application has proposed another synthetic resin ampule disclosed in, for example, WO2017/115752 (Patent Document 4). The synthetic resin ampule of Patent Document 4 includes an ampule body 7 capable of standing by itself and a drug 8 filled in the ampule body 7. The ampule body 7 has a tip portion 3 located on the upper side when the ampule body stands by itself, a hollow portion 71 having a drug containing portion 78, and a breakable portion 5 provided between a lower portion of the tip portion 3 and an upper portion of the hollow portion 71. The tip portion 3 has pressing portions 31 and 32 for guiding a pressing force applied thereto in a predetermined direction when an operation of breaking the breakable portion 5 is performed. The hollow portion 71 has a bottom surface portion 9 for allowing the ampule body to stand by itself. The bottom surface portion 9 has extension portions 41 and 42 extending in the predetermined direction (X direction, Y direction) in which the pressing portions 31 and 32 are guided during the breaking operation.

PRIOR ART DOCUMENTS

Patent Documents

Patent Document 1: Japanese Patent Application Laid-Open (kokai) No. 2014-069856

Patent Document 2: Japanese Patent Application Laid-Open (kokai) No. 2013-095436

Patent Document 3: WO2017/159832 (US2019015297A1)

Patent Document 4: WO2017/115752 (US2018303710A1)

SUMMARY OF THE INVENTION

Problems to be Solved by the Invention

Since the synthetic resin ampules of Patent Documents 1 to 4 are formed of synthetic resins, they suffer little damages upon falling and their handling is easy.

In each of the synthetic resin ampules of Patent Documents 1, 3, and 4, a portion located above the breakable portion is pressed so as to break the breakable portion, thereby opening the ampule. In the synthetic resin ampule of Patent Document 2, the head portion 7 is pushed upward so as to open the stopper portion 5 (ampule).

Many synthetic resin ampules conventionally used are not of a hard type as in Patent Documents 3 and 4, but are of a soft type and are formed by blow molding. Such a soft-type synthetic resin ampule is opened by cutting through twisting (hereinafter referred to as "twist-cut operation"). Therefore, medical workers who open ampules are familiar with the twist-cut operation. Also, problems of soft-type synthetic resin ampules have been pointed out. Specifically, since such a soft-type synthetic resin ampule is soft and stretches easily, lint-like debris is produced at an opening formed as a result of the ampule being opened. When the body of the ampule is gripped, the liquid filled therein spills out. A drug easily adheres to the ampule. The liquid filled in the ampule easily transpires.

In view of the forgoing, an object of the present invention is to provide a drug-filled synthetic resin ampule filled a drug therein which includes a tip portion, a hollow portion having a drug containing portion, an annular breakable portion provided between a lower portion of the tip portion and an upper portion of the hollow portion and in which the breakable portion can be easily broken by a twisting operation so as to open the ampule. Another object of the present invention is to provide an ampule body used in such a drug-filled synthetic resin ampule.

Means for Solving the Problems

In order to achieve the above-described objects, the following is provided.

A drug-filled synthetic resin ampule comprises a hollow ampule body, a lower-end-side sealing member for sealing a lower end of the ampule body, and a drug contained in the ampule body; wherein the ampule body includes a tip-side sealing portion, a hollow portion located below the tip-side sealing portion and having a drug containing portion therein, and an annular breakable portion provided between a lower portion of the tip-side sealing portion and an upper portion of the hollow portion; the tip-side sealing portion includes a flat plate portion for grasping formed at an upper portion thereof and an internal ceiling portion exposed to an interior of the hollow portion; and the breakable portion includes an annular smallest diameter portion which is located near an annular circumferential edge portion of the internal ceiling portion and is located above the annular circumferential edge portion of the internal ceiling portion.

Also, in order to achieve the above-described object, the following is provided.

A synthetic resin ampule body for a drug-filled ampule, comprises a tip-side sealing portion, a hollow portion having a drug containing portion, and an annular breakable portion provided between a lower portion of the tip-side sealing portion and an upper portion of the hollow portion;

wherein the breakable portion includes an annular smallest diameter portion, and the tip-side sealing portion includes a flat plate portion for grasping formed at an upper portion thereof and an internal ceiling portion exposed to an interior of the hollow portion; and the smallest diameter portion of the breakable portion is located near an annular circumferential edge portion of the internal ceiling portion and is located above the annular circumferential edge portion of the internal ceiling portion.

MODES FOR CARRYING OUT THE INVENTION

Figure 1:
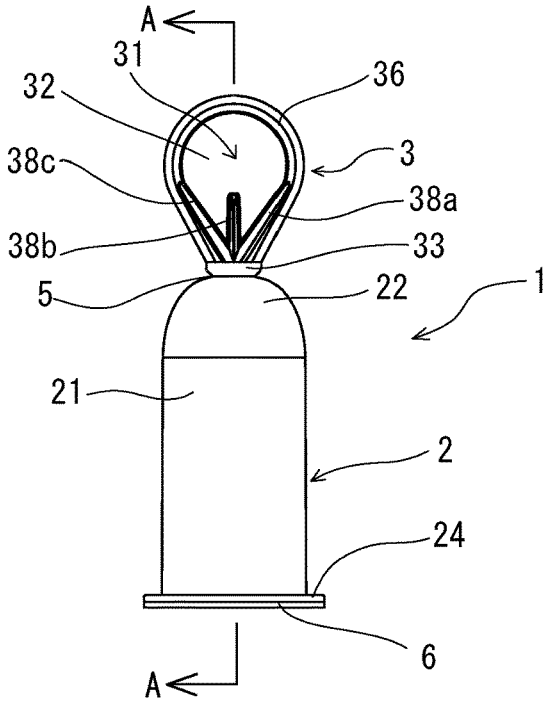
FIG. 1 is a front view of a drug-filled synthetic resin ampule of one embodiment of the present invention.

An embodiment of the present invention will now be described in detail with reference the accompanying drawings.

A drug-filled synthetic resin ampule 1 of the present invention includes a hollow ampule body 2, a lower-end-side sealing member 6 for sealing the lower end of the ampule body 2, and a drug 8 filled in the ampule body 2.

In this embodiment, the ampule body 2 includes a tip-side sealing portion 3, a hollow portion 21 located below the tip-side sealing portion 3 and having a drug containing portion 23 therein, and an annular breakable portion 5 provided between a lower portion of the tip-side sealing portion 3 and an upper portion of the hollow portion 21. The tip-side sealing portion 3 includes a flat plate portion for grasping (gripping) 32 formed at an upper portion thereof and an internal ceiling portion 37 exposed to the interior of the hollow portion 21. The breakable portion 5 has an annular smallest diameter portion 51 formed to have an acute angle. Further, the smallest diameter portion (smallest outer diameter portion) 51 of the breakable portion 5 is located near an annular circumferential edge portion 37*a* of the internal ceiling portion 37 and is located above the annular circumferential edge portion 37*a* of the internal ceiling portion 37.

The ampule 1 of the present invention is configured such that, when the flat plate portion for grasping 32 of the tip-side sealing portion 3 is grasped and twisted, the ampule 1 is broken at the breakable portion 5. In particular, since the tip-side sealing portion 3 includes the flat plate portion for grasping 32 formed at an upper portion thereof, the twisting operation is easy. Moreover, since the smallest diameter portion 51 of the breakable portion 5 is located near the annular circumferential edge portion 37*a* of the internal ceiling portion 37 and is located above the annular circumferential edge portion 37*a* of the internal ceiling portion 37. The synthetic resin ampule can be broken well by the twisting operation. The minimum diameter portion 51 of the breakable portion 5 is located on the tip end side of the ampule body 2 with respect to the annular circumferential edge portion 37*a* of the internal ceiling portion 37. Also, this synthetic resin ampule can be broken by pressing down the tip-side sealing portion 3.

As shown in FIGS. 1 to 6, the drug-filled synthetic resin ampule 1 of the present invention includes the hollow ampule body 2, the drug 8 filled in the ampule body 2, and the lower-end-side sealing member 6 for sealing the lower end opening of the ampule body.

As shown in FIGS. 1 to 3, 6, and 7, the drug-filled synthetic resin ampule 1 can stand by itself.

The ampule body 2 includes the tip-side sealing portion 3 located above the drug 8, the hollow portion 21 having the drug containing portion 23, the breakable portion 5 provided between the lower portion of the tip-side sealing portion 3 and the upper portion of the hollow portion 21, and the lower flange 24.

The ampule body 2 includes the hollow portion 21 having a lower end opening and extending upward, the tip-side sealing portion 3 located above the hollow portion and closing an upper opening of the hollow portion and the breakable portion 5 provided between the lower portion of the tip-side sealing portion 3 and the upper portion of the hollow portion 21. The breakable portion 5 is provided to form a boundary portion between the tip-side sealing portion 3 and the hollow portion 21.

Figure 6:
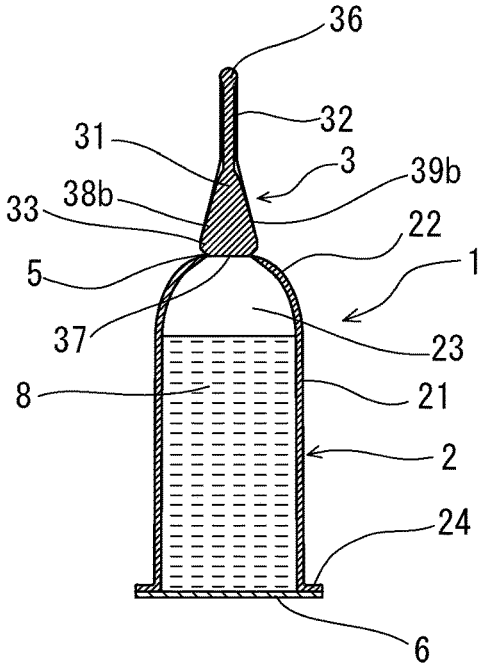
FIG. 6 is a sectional view taken along line A-A of FIG. 1.
Figure 7:
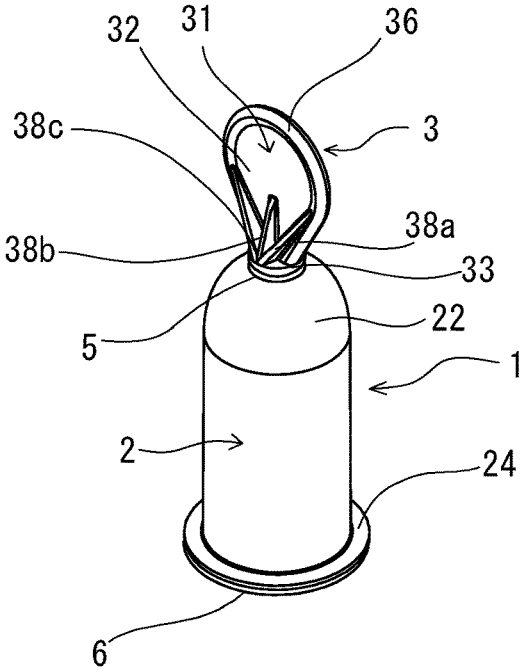
FIG. 7 is a perspective view of the drug-filled synthetic resin ampule of FIG. 1.

The hollow portion 21 includes the drug containing portion 23. Preferably, the volume of the drug containing portion 23 is about 0.5 ml to 50 ml. As shown in FIG. 6, the hollow portion 21 has a cylindrical portion extending over a predetermined length while maintaining approximately constant outer and inner diameters, and a diameter reducing portion 22 located above the cylindrical portion. Therefore, in the ampule 1 of the present embodiment, both the outer and inner diameters of the hollow portion 21 decrease toward the breakable portion 5.

The entirety of the ampule body 2, including the breakable portion 5, is preferably formed by injection molding. The inner diameter of the cylindrical portion is preferably 6 mm to 33 mm, particularly preferably 7 mm to 24 mm. The outer diameter of the cylindrical portion is preferably 7 mm to 35 mm, particularly preferably 10 mm to 25 mm. The inner diameter of the diameter reducing portion 22 at its small diameter portion is preferably 3 mm to 12 mm, particularly preferably 3 mm to 9 mm.

The tip-side sealing portion 3 forms an upper portion of the ampule body 2 and is located at the upper portion of the ampule body 2. As shown in FIGS. 1 to 6, the tip-side sealing portion 3 has the flat plate portion for grasping 32 formed at an upper portion thereof.

Figure 2:
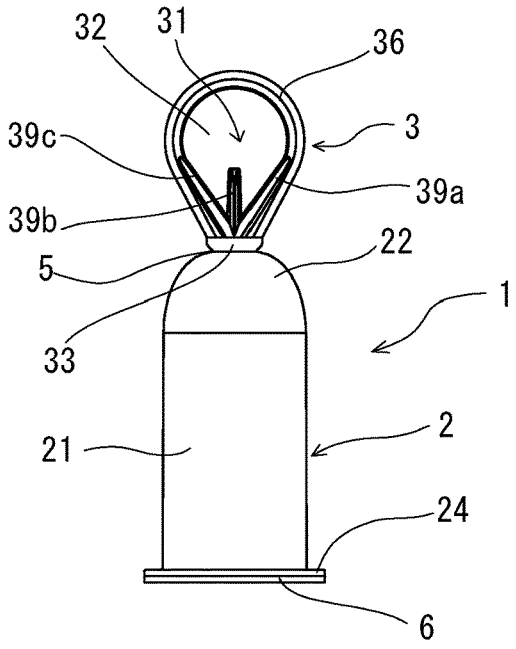
FIG. 2 is a back view of the drug-filled synthetic resin ampule of FIG. 1.
Figure 3:
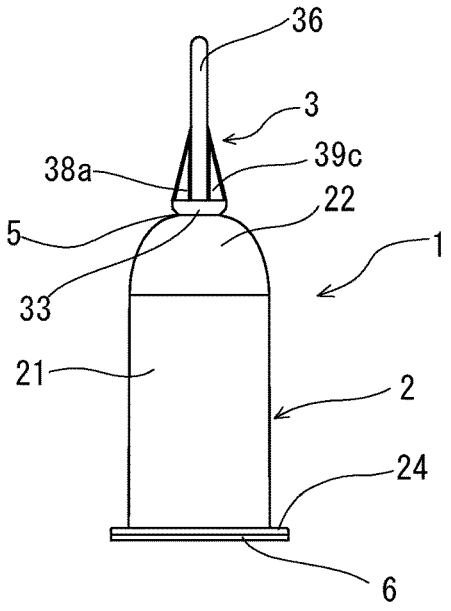
FIG. 3 is a right side view of the drug-filled synthetic resin ampule of FIG. 1.
Figure 4:
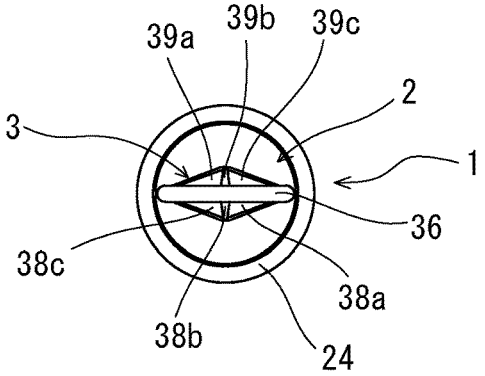
FIG. 4 is a plan view of the drug-filled synthetic resin ampule of FIG. 1.
Figure 5:
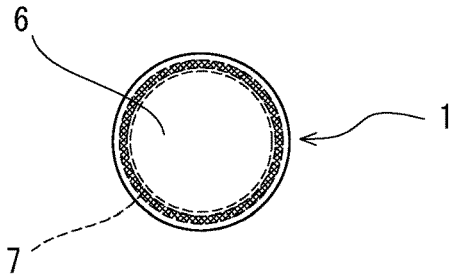
FIG. 5 is a bottom view of the drug-filled synthetic resin ampule of FIG. 1.

In the ampule 1 of the present embodiment, the tip-side sealing portion 3 has a base plate portion 31 and the flat plate portion for grasping 32 provided at an upper portion of the base plate portion 31. As shown in FIGS. 1 and 2, the flat plate portion for grasping 32 is flat on opposite sides so as to allow a user to easily grasp the opposite surfaces with his/her fingers. The flat plate portion for grasping 32 has, on the opposite sides, flat surfaces which do not have protrusions or the like.

In the present embodiment, a bulging portion 36 is provided at the circumferential edge of the flat plate portion for grasping 32; in other words, at the circumferential edge of an upper portion of the base plate portion 31. Therefore, when the user grasps the opposite sides of the flat plate portion for grasping 32 with his/her fingers, the fingers are less likely to slip; in other words, the grasped state can be maintained well. The bulging portion 36 also functions as a reinforcing portion for the base plate portion 31 of the tip-side sealing portion 3. In the present embodiment, the flat plate portion for grasping 32; in other words, the upper portion of the base plate portion 31 has an arc shape; i.e., does not have corners at the circumferential edge thereof.

As shown in FIGS. 1 to 6, the tip-side sealing portion 3 has a lower disk portion 33 provided at the lower end of the base plate portion 31. The base plate portion 31 extends upward from the upper surface of the lower disk portion 33.

In the present embodiment, the tip-side sealing portion 3 has reinforcing portions extending upward from a lower portion thereof and ending at a lower end portion of the flat plate portion for grasping 32. Specifically, reinforcing portions 38*a*, 38*b*, and 38*c* are provided on one surface of the base plate portion 31. The lower ends of the reinforcing portions 38*a*, 38*b*, and 38*c* are located on the upper surface of the lower disk portion 33, and the reinforcing portions 38*a*, 38*b*, and 38*c* extend in a direction toward the tip over a predetermined length. The reinforcing portions 38*a*, 38*b*, and 38*c* are ribs formed perpendicularly to the base plate portion 31. The number of the reinforcing portions is preferably two or more and may be three or more.

In particular, in the present embodiment, as shown in FIG. 1, the reinforcing portions 38*a* and 38*c* formed on the one surface of the base plate portion 31 have their starting ends on the upper surface of the lower disk portion 33, extend obliquely upward over a predetermined length, and end at positions along the circumferential edge, the positions corresponding to a center portion of the tip-side sealing portion 3. The reinforcing portion 38*b* has its starting end on the upper surface of the lower disk portion 33, extends upward along the axial direction of the ampule body 2 over a predetermined length, and ends at the center portion of the tip-side sealing portion 3.

Similarly, as shown in FIG. 2, reinforcing portions 39*a*, 39*b*, and 39*c* are provided on the other surface of the base plate portion 31. The lower ends of the reinforcing portions 39*a*, 39*b*, and 39*c* are located on the upper surface of the lower disk portion 33, and the reinforcing portions 39*a*, 39*b*, and 39*c* extend in the direction toward the tip over a predetermined length. The reinforcing portions 39*a*, 39*b*, and 39*c* are ribs formed perpendicularly to the base plate portion 31. The reinforcing portions 39*a* and 39*c* formed on the other surface of the base plate portion 31 have their starting ends on the upper surface of the lower disk portion 33, extend obliquely upward over a predetermined length, and end at positions along the circumferential edge, the positions corresponding to a center portion of the tip-side sealing portion 3. The reinforcing portion 39*b* has its starting end on the upper surface of the lower disk portion 33, extends upward along the axial direction of the ampule body 2 over a predetermined length, and ends at the center portion of the tip-side sealing portion 3.

Figure 8:
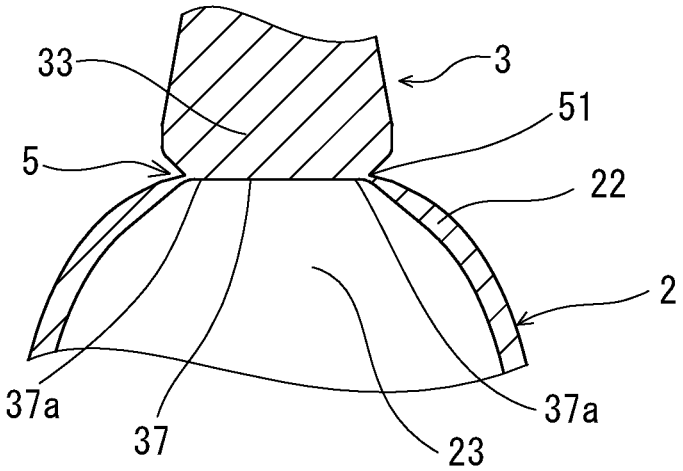
FIG. 8 is an enlarged sectional view of a breakable portion and its vicinity of the synthetic resin ampule shown in FIG. 6.
Figure 9:
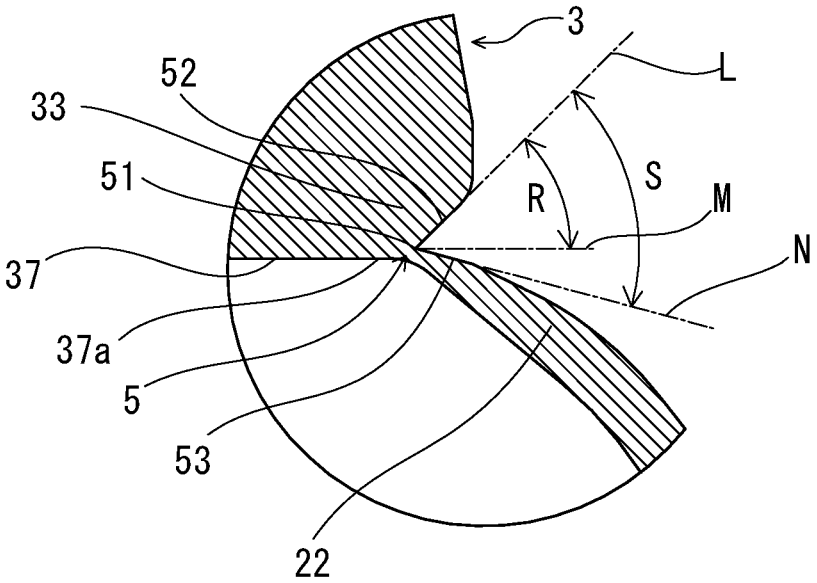
FIG. 9 is an enlarged sectional view of the breakable portion of the synthetic resin ampule shown in FIG. 6.

Since the reinforcing portions have the above-described shapes, the flat portion for grasping 32 which is sufficiently large and on which the reinforcing portions are not located is secured at an upper portion of the tip-side sealing portion 3. Also, as shown in FIGS. 6, 8, and 9, the tip-side sealing portion 3 has the internal ceiling portion 37 exposed to the interior of the hollow portion 21.

The ampule body 2 includes the annular breakable portion 5 provided between the lower portion of the tip-side sealing portion 3 and the upper portion of the hollow portion 21. The breakable portion 5 is a thin weak portion provided near the boundary between the drug containing portion 23 and the tip-side sealing portion 3. In the present embodiment, the thin weak portion (breakable portion) is formed as a result of formation of an annular groove on the outer surface of the ampule body 2. The annular breakable portion 5 is formed by an annular groove formed on the outer surface of the ampoule body 2. Specifically, the breakable portion 5 is formed on the outer surface of an upper end portion of the diameter reducing portion 22 of the ampule body 2. When the ampule body 2 is broken at the breakable portion 5, the drug containing portion 23 is opened.

The breakable portion 5 has a V-shaped cross section and the annular smallest diameter portion 51 formed to have an acute angle. The breakable portion 5 is formed by an annular groove formed at an acute angle from the outside to the inside of the ampoule body 2. The inner apex of the annular groove is the annular smallest outer diameter portion 51. The breakable portion 5 is formed by an apex portion of an annular groove whose diameter is reduced so as to have an acute angle from the outside to the inside of the ampoule body 2. The smallest diameter portion 51 of the breakable portion 5 is located near the annular circumferential edge portion 37*a* of the internal ceiling portion 37 and is located on the upper side of the annular circumferential edge portion 37*a* of the internal ceiling portion 37 (on the side toward an upper portion of the ampule body 2). In the ampule 1 of the present embodiment, the internal ceiling portion 37 of the tip-side sealing portion 3 is flat, and the entirety of the internal ceiling portion 37 is located below the smallest diameter portion 51 (on the side toward a lower portion of the ampule body 2).

The wall thickness of the ampule body 2 at the smallest diameter portion 51 of the breakable portion 5 (the distance between the smallest diameter portion 51 and the inner surface of the ampule body 2) is preferably 0.05 mm to 0.30 mm.

A plane defined by the smallest diameter portion 51 of the breakable portion 5 is located close to the internal ceiling portion 37 of the tip-side sealing portion 3. The plane defined by the smallest diameter portion 51 of the breakable portion 5 is separated from the internal ceiling portion 37 of the tip-side sealing portion 3 by a predetermined distance W. The distance W is preferably 0.05 mm to 0.25 mm.

As described above, the breakable portion 5 has a V-shaped cross section.

Specifically, as shown in FIG. 9, the breakable portion 5 has an annular upper sloping portion 52 extending upward from the smallest diameter portion 51 and an annular lower sloping portion 53 extending downward from the smallest diameter portion 51. The angle S between the annular upper sloping portion 52 and the annular lower sloping portion 53 is preferably 30° to 90°, particularly preferably, 45° to 75°.

Since the portions forming a groove to have such an angle therebetween are formed, when the tip-side sealing portion 3 is twisted, a sufficiently large stress acts on the breakable portion. Therefore, the breakable portion can be broken easily.

Also, the angle R between the above-described annular upper sloping portion 52 and a horizontal line M passing through an imaginary annular plane formed by the smallest diameter portion 51 (apex) of the breakable portion 5 is preferably 15° to 75°, particularly preferably, 30° to 60°.

In the ampule 1 of the present embodiment, a distal end portion of the diameter reducing portion 22 provided above the hollow portion 21 of the ampule body 2 gradually decreases in wall thickness toward the smallest diameter portion 51 of the breakable portion 5. The wall thickness at the smallest diameter portion 51 is the smallest. In the diameter reducing portion 22 of the ampoule body 2, the wall thickness at the smallest diameter portion 51 is the smallest. As shown in FIG. 9, a corner portion of the internal ceiling portion 37; in other words, a corner portion of an upper inner surface of the hollow portion 21 has preferably an edge-free curved surface.

The ampule body 2 has a lower end opening and has a flange 24 provided at the lower end. The flange 24 has the shape of a flat plate extending outward from the lower end of the hollow portion 21. In the present embodiment, the flange 24 extends to have the shape of an annular plate.

The ampule 1 includes the sealing member 6 for sealing the lower end opening of the ampule body 2. In the present embodiment, the sealing member 6 has an approximately flat bottom surface. Therefore, the synthetic resin ampule 1 stands by itself, without wobbling, in a state in which the tip-side sealing portion 3 is in an approximately upright posture. The sealing member 6 is liquid-tightly fixed to the lower surface of the flange 24 of the ampule body 2 by a seal portion 7. The seal portion is preferably formed by ultrasonic sealing, high frequency sealing, or the like.

The drug-filled synthetic resin ampule of the present invention may be an ampule 1*a* shown in FIGS. 10 to 17.

The drug-filled synthetic resin ampule 1*a* of the present embodiment includes a hollow ampule body 2*a*, the drug 8 filled in the ampule body 2*a*, and a lower-end-side sealing member 6*a* for sealing the lower end opening of the ampule body 2*a*. The ampule 1*a* of the present embodiment is also broken at the breakable portion 5 as a result of the flat plate portion for grasping 32 of a tip-side sealing portion 3*a* being grasped and twisted. The drug-filled synthetic resin ampule 1*a* of the present embodiment can also stand by itself.

The ampule 1*a* of the present embodiment is identical with the ampule 1 of the above-described embodiment except for the shape of the reinforcing portions provided on the tip-side sealing portion and the shape of the flange.

The ampule body 2*a* includes the tip-side sealing portion 3*a* located at an upper portion thereof, the hollow portion 21 having the drug containing portion 23, the annular breakable portion 5 provided between the lower portion of the tip-side sealing portion 3*a* and the upper portion of the hollow portion 21, and a lower end flange 24*a*. The tip-side sealing portion 3*a* has the flat plate portion for grasping 32 formed at an upper portion thereof. Therefore, the twisting operation is easy. Furthermore, since the smallest diameter portion (smallest outer diameter portion) 51 of the breakable portion 5 is located near the annular circumferential edge portion 37*a* of the internal ceiling portion 37 and is located above the annular circumferential edge portion 37*a* of the internal ceiling portion 37, the synthetic resin ampule can be broken well by the twisting operation. Also, this synthetic resin ampule can be broken by pressing down the tip-side sealing portion 3*a*.

Figure 10:
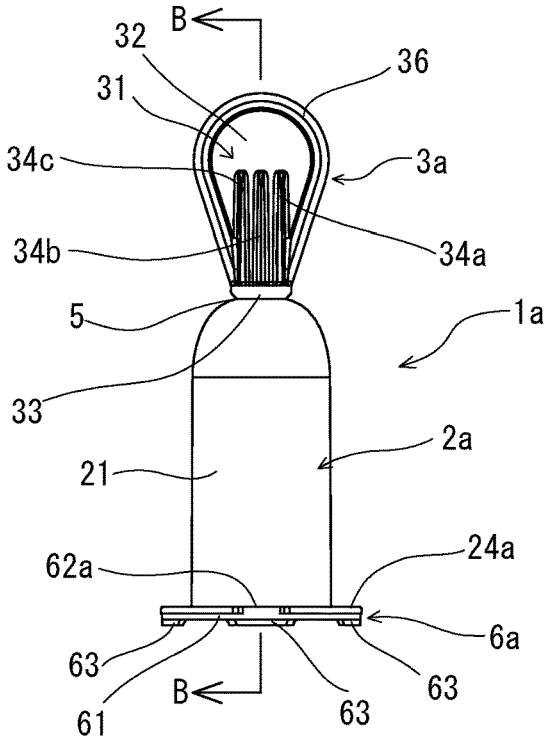
FIG. 10 is a front view of a drug-filled synthetic resin ampule of another embodiment of the present invention.
Figure 11:
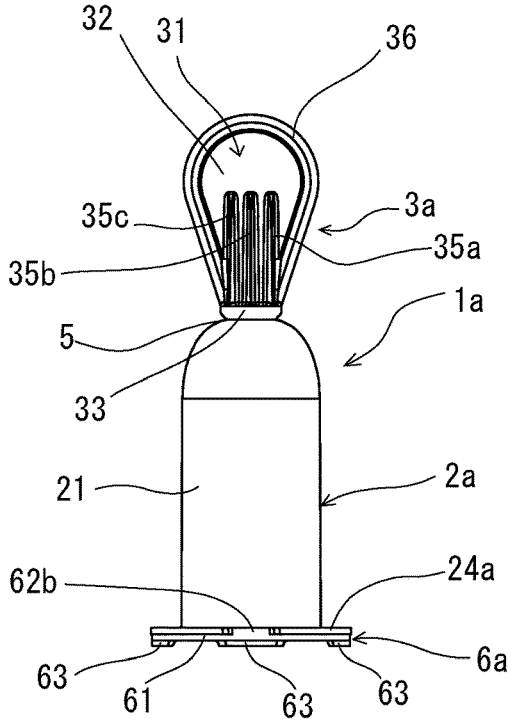
FIG. 11 is a back view of the drug-filled synthetic resin ampule of FIG. 10.
Figure 12:
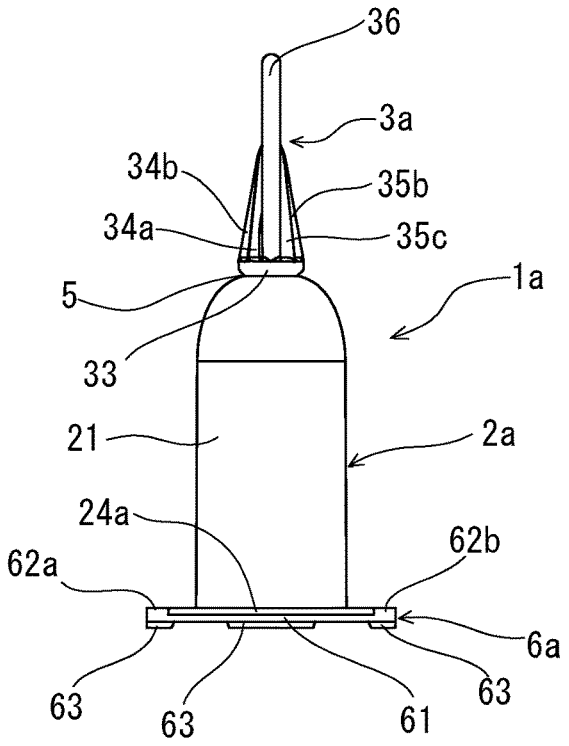
FIG. 12 is a right side view of the drug-filled synthetic resin ampule of FIG. 10.
Figure 16:
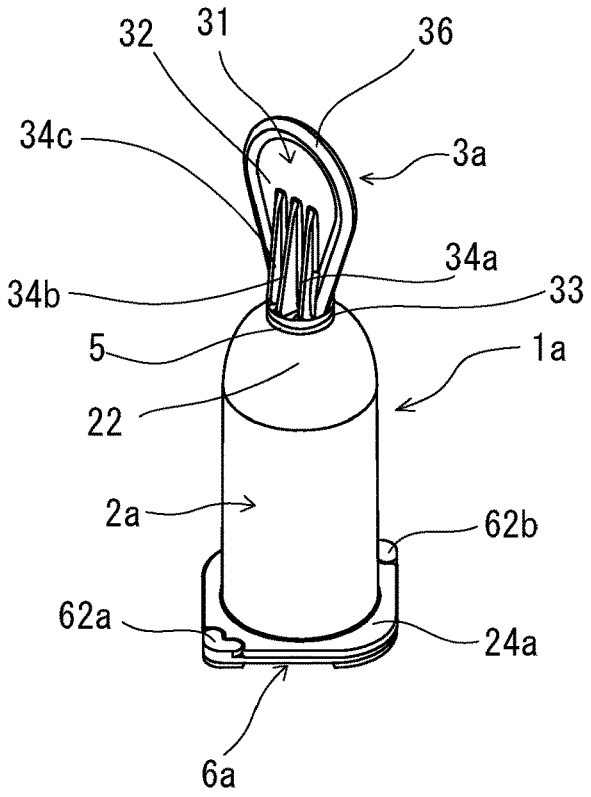
FIG. 16 is a perspective view of the drug-filled synthetic resin ampule of FIG. 10.
Figure 17:
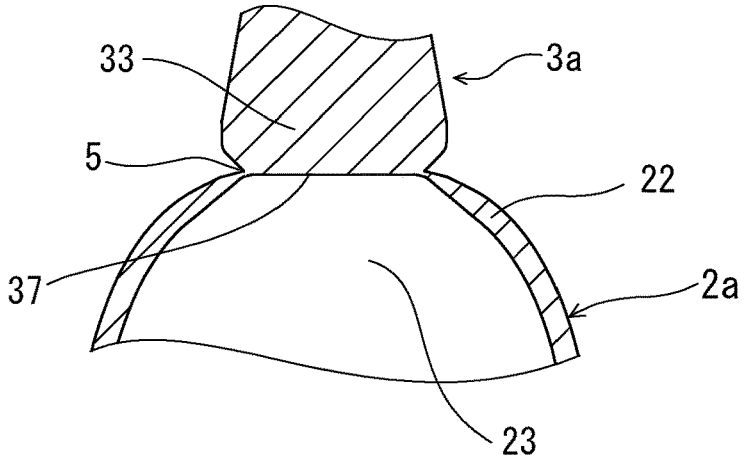
FIG. 17 is an enlarged sectional view of a breakable portion and its vicinity of the synthetic resin ampule shown in FIG. 15.

The tip-side sealing portion 3*a* forms an upper portion of the ampule body 2*a* and is located at the upper portion of the ampule body 2*a*. As shown in FIGS. 10, 11, and 16, the tip-side sealing portion 3*a* has the flat plate portion for grasping 32 formed at an upper portion thereof. In the ampule 1*a* of the present embodiment as well, the tip-side sealing portion 3*a* has the base plate portion 31 and the flat plate portion for grasping 32 provided at an upper portion of the base plate portion 31. As shown in these drawings, the flat plate portion for grasping 32 is flat on opposite sides so as to allow a user to easily grasp the opposite surfaces with his/her fingers. The flat plate portion for grasping 32 has, on the opposite sides, flat surfaces which do not have protrusions or the like. The bulging portion 36 is provided at the circumferential edge of the flat plate portion for grasping 32; in other words, at the circumferential edge of an upper portion of the base plate portion 31.

As shown in FIGS. 10 to 16, the tip-side sealing portion 3*a* has the lower disk portion 33 provided at the lower end of the base plate portion 31. The base plate portion 31 extends upward from the upper surface of the lower disk portion 33.

In the present embodiment, the tip-side sealing portion 3*a* has reinforcing portions extending upward from a lower portion thereof and ending at a lower end portion of the flat plate portion for grasping 32. Specifically, reinforcing portions 34*a*, 34*b*, and 34*c* are provided on one surface of the base plate portion 31. The lower ends of the reinforcing portions 34*a*, 34*b*, and 34*c* are located on the upper surface of the lower disk portion 33, and the reinforcing portions 34*a*, 34*b*, and 34*c* extend in the direction toward the tip over a predetermined length. The reinforcing portions 34*a*, 34*b*, and 34*c* are ribs formed perpendicularly to the base plate portion 31. The number of the reinforcing portions is preferably two or more and may be three or more.

In particular, in the present embodiment, as shown in FIG. 10, the reinforcing portions 34*a*, 34*b*, and 34*c* formed on the one surface of the base plate portion 31 have their starting ends on the upper surface of the lower disk portion 33, extend upward along the axial direction of the ampule body 2*a* over a predetermined length, and end at the center portion of the tip-side sealing portion 3*a*. The reinforcing portions 34*a*, 34*b*, and 34*c* are approximately parallel to each other.

Similarly, as shown in FIG. 11, the reinforcing portions 35*a*, 35*b*, and 35*c* formed on the other surface of the base plate portion 31 have their starting ends on the upper surface of the lower disk portion 33, extend upward along the axial direction of the ampule body 2*a* over a predetermined length, and end at the center portion of the tip-side sealing portion 3*a*. The reinforcing portions 35*a*, 35*b*, and 35*c* are approximately parallel to each other. Since the reinforcing portions have the above-described shapes, the flat portion for grasping 32 which is sufficiently large and on which the reinforcing portions are not located is secured at an upper portion of the tip-side sealing portion 3*a*.

Figure 13:
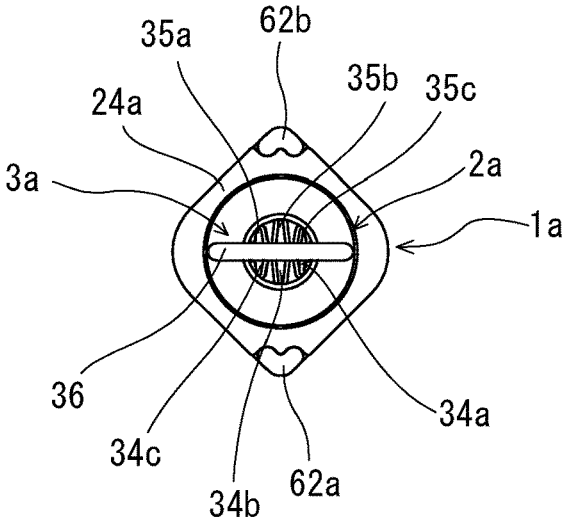
FIG. 13 is a plan view of the drug-filled synthetic resin ampule of FIG. 10.
Figure 14:
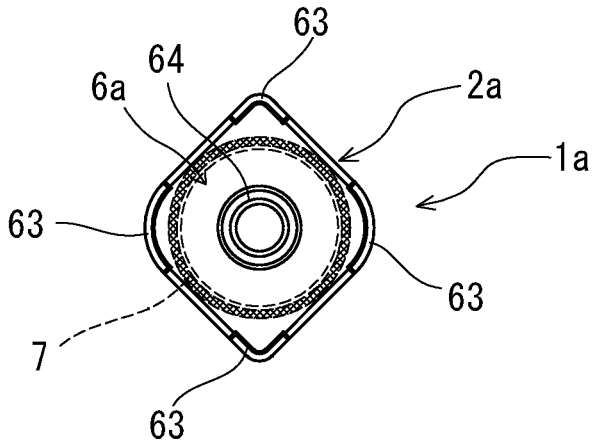
FIG. 14 is a bottom view of the drug-filled synthetic resin ampule of FIG. 10.
Figure 15:
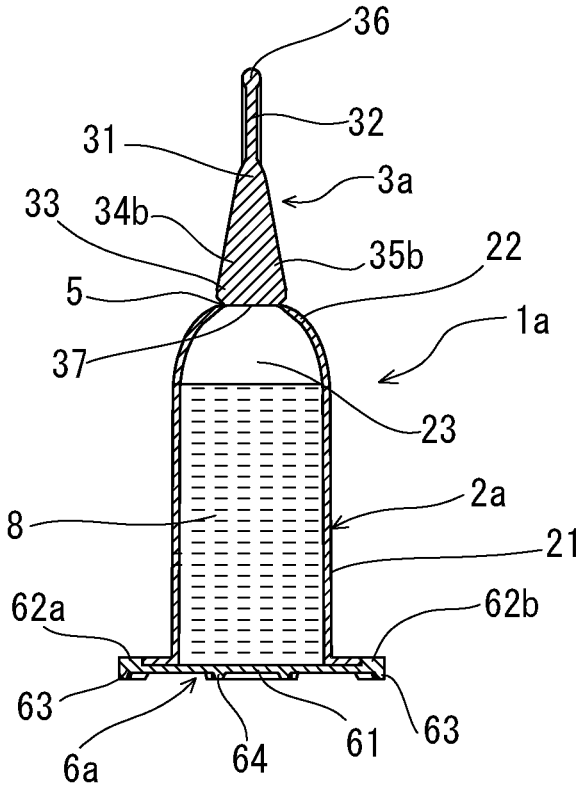
FIG. 15 is a sectional view taken along line B-B of FIG. 10.

The ampule body 2*a* has a lower end opening and has the flange 24*a* provided at the lower end. The flange 24*a* has the shape of a flat plate extending outward from the lower end of the hollow portion 21. In the present embodiment, as shown in FIGS. 13 and 14, the flange 24*a* is an approximately rectangular plate-shaped portion. The flange 24*a* has a pair of curved corner portions located opposite each other and a pair of corner portions having wavy peripheral edge portions.

The sealing member 6*a* for sealing the lower end opening of the ampule body 2*a* has a plate-shaped body portion 61 and protruding portions 62*a* and 62*b* which protrude upward from opposite corner portions of the body portion 61 and which has wavy inner surfaces. The inner surfaces of the protruding portions 62*a* and 62*b* define inner-side wavy peripheral edge portions corresponding to outer-side wavy peripheral edge portions of the flange 24*a*. The two outer-side wavy peripheral edge portions of the flange 24*a* are in engagement with the two protruding portions 62*a* and 62*b* of the sealing member 6*a* which have the inner-side wavy peripheral edge portions.

Also, the sealing member 6*a* has lower protruding portions 63 provided on the lower surfaces of the corner portions and an annular protruding portion 64 provided at a center portion. Their lower surfaces are formed to be located on the same plane. Therefore, the ampule 1*a* stands well by itself without wobbling.

The sealing member 6*a* is liquid-tightly fixed to the lower surface of the flange 24*a* of the ampule body 2*a* by means the seal portion 7. Notably, the outer shape of the sealing member 6*a* is rectangular. Specifically, the sealing member 6*a* has an approximately square shape and rounded corners. Therefore, when the ampule 1*a* is toppled down, rotation or swing of the ampule is prevented.

The hollow portion (the drug containing portion 23) of the ampule body 2, 2*a* is preferably transparent such that the drug filled therein is visible. Although the drug accommodation portion 23 of the ampule body 2, 2*a* may have ordinary pressure, the drug accommodation portion 23 may have a decreased pressure or may be in a vacuum state. In a case where the drug accommodation portion has a decreased pressure or is in a vacuum state, it is possible to increase the effect of preventing the drug from altering, decomposing and deteriorating.

The drug 8 filled in the drug accommodation portion is a liquid agent. Examples of the drug include analgesic agents such as morphine (a narcotic analgesic agent), insulin, antitumor agents, cardiotonic agents, intravenous anesthetic agents, antiparkinson agents, ulcer therapeutic agents, adrenocortical hormone agents, antiarrhythmic agents, correction electrolytes, antiviral agents, immunostimulants, antibiotics, local anesthetic agents such as xylocaine, vitamins, multivitamin preparations, various amino acids, anti-thrombotic agents such as heparin. In particular, drugs such as narcotic analgesic agents and antitumor agents needed to be handled and managed with care are preferable.

The materials used to form the ampule bodies 2 and 2*a* and the sealing members 6 and 6*a* are preferably those which allow the ampules 1 and 1*a* to be sterilized by pressurized steam. In particular, the materials are preferably those which can be adapted to overkill conditions (ISO/TS 17665-2). Also, since the synthetic resin ampule body is formed by injection molding, it is preferred to use various types of hard or semi-hard resin materials suitable for injection molding.

Specific examples of the materials for forming the ampule bodies 2 and 2*a* and the sealing members 6 and 6*a* include rigid polyvinyl chloride; polyolefins, such as polyethylene, polypropylene, polybutadiene, cyclic polyolefins (e.g., ZEONEX (manufactured by Zeon Corporation) and APEL (manufactured by Mitsui Chemicals, Inc.)), polypropylene homopolymer, and high-density polyethylene; polystyrene; poly-(4-methylpentene-1); polycarbonates; ABS resins; acrylic resins; polymethyl methacrylate (PMMA); polyacetals; polyarylates; polyacrylonitrile; polyvinylidene fluoride; ionomers; acrylonitrile-butadiene-styrene copolymers; polyesters, such as polyethylene terephthalate (PET) and polybutylene terephthalate (PBT); butadiene-styrene copolymers; resins such as aromatic and aliphatic polyamides; and any combination of these.

Preferably, the inner surface of the tip-side sealing portion 3 is a surface whose drug retaining capacity is low (hereinafter referred to as a "low-drug-retention surface"). In the ampule 1 of the present embodiment, the internal ceiling portion 37 of the tip-side sealing portion 3 is flat and has a low-drug-retention surface. Also, each of the inner surfaces (side and ceiling surfaces) of the tip-side sealing portion 3 may be a water-repellent surface. The water-repellent surface can limit adhesion of the drug. The water-repellent surface may be realized by the water repellency of the resin which forms the tip portion or may be formed by providing a film of a water repellent substance on the inner surface of the tip portion. The water repellent film can be formed by coating the inner surface with a water repellent coating agent which is then cured.

The water repellent film may be provided over the entire inner surface of the hollow portion 21 or may be provided over the entire inner surface of the ampule body 2, including the upper surface of the bottom portion thereof. The water-repellent film is preferably formed of, for example, a fluororesin, a silicone resin, or poly(p-xylylene).

The fluororesin is preferably, for example, an ethylene tetrafluoride-perfluoroethoxyethylene copolymer, polytetrafluoroethylene, a tetrafluoroethylene-perfluoroalkyl vinyl ether copolymer, or a tetrafluoroethylene-hexafluoropropylene copolymer.

The silicone resin is formed from a silicone compound, such as a dimethylsilicone compound or an alkoxysilane compound, particularly preferably a trialkoxysilane compound. The alkoxy group is generally a methoxy group or an ethoxy group. The group responsible for water repellency is selected from the group consisting of a methyl group and a fluoroalkyl group.

The drug-filled synthetic resin ampule of the present invention may be an ampule 1*b* shown in FIGS. 18 to 22.

The drug-filled synthetic resin ampule 1*b* of the present embodiment includes a hollow ampule body 2*b*, the lower-end-side sealing member 6 for sealing the lower end of the ampule body 2*b*, and the drug 8 filled in the ampule body 2*b*.

The ampule body 2*b* includes a tip-side sealing portion 3*b*, the hollow portion 21 located below the tip-side sealing portion 3*b* and having the drug containing portion 23 therein, and an annular breakable portion 5*a* provided between a lower portion of the tip-side sealing portion 3*b* and an upper portion of the hollow portion 21. The tip-side sealing portion 3*b* includes the flat plate portion for grasping 32 formed at an upper portion thereof and the internal ceiling portion 37 exposed to the interior of the hollow portion 21. The breakable portion 5*a* has an annular smallest diameter portion (smallest outer diameter portion) 51*a*. Further, the smallest diameter portion 51*a* of the breakable portion 5*a* is located near the annular circumferential edge portion 37*a* of the internal ceiling portion 37 and is located above the annular circumferential edge portion 37*a* of the internal ceiling portion 37.

The ampule 1*b* of the present embodiment is identical with the ampule 1 of the above-described embodiment except for the shape of the smallest diameter portion 51*a* of the breakable portion 5*a* and the shape of the upper portion of the tip-side sealing portion 3*b*.

The drug-filled synthetic resin ampule 1*b* of the present embodiment is also broken at the breakable portion 5*a* as a result of the flat plate portion for grasping 32 of the tip-side sealing portion 3*b* being grasped and twisted. As shown in the drawings, the ampule 1*b* of the present embodiment can also stand by itself.

The ampule 1*b* of the present embodiment is identical with the ampule 1 of the above-described embodiment except for the shape of the breakable portion 5*a*. Now, only the shape of the smallest diameter portion 51*a* of the breakable portion 5*a* and the shape of the upper portion of the tip-side sealing portion 3*b*, which are the differences between the ampule 1*b* of the present embodiment and the above-described ampule 1, will be described with reference to the drawings.

Figure 22:
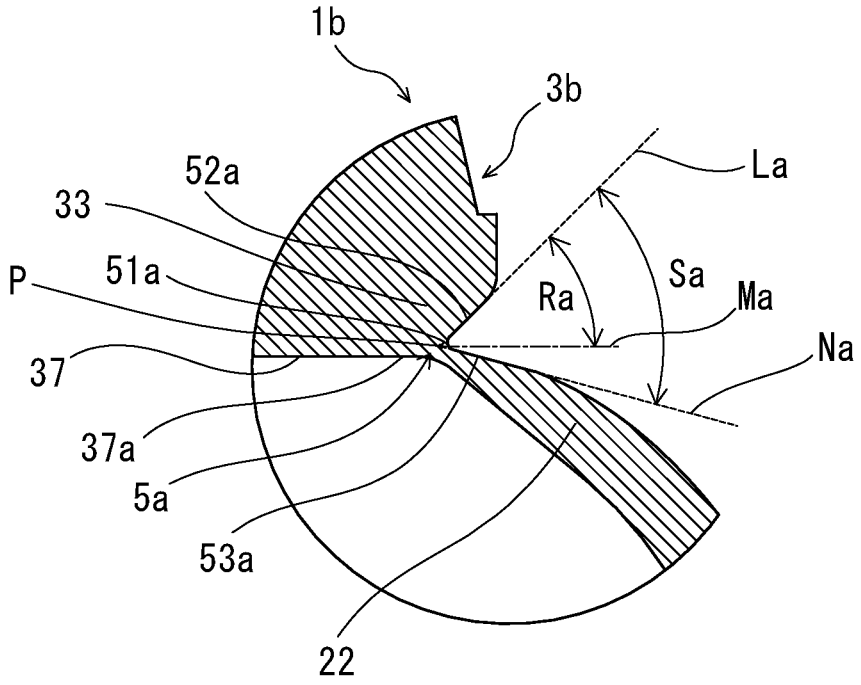
FIG. 22 is an enlarged sectional view of a breakable portion and its vicinity of the synthetic resin ampule shown in FIG. 20.

As shown in FIG. 22, in the ampule 1*b* of the present embodiment, the annular smallest diameter portion 51*a* is slightly rounded. Specifically, the smallest diameter portion 51*a* of the breakable portion 5*a* has a cross section having the shape of a short arc.

Specifically, as shown in FIG. 22, the breakable portion 5*a* has an annular upper sloping portion 52*a* extending upward from the smallest diameter portion 51*a* and an annular lower sloping portion 53*a* extending downward from the smallest diameter portion 51*a*.

The annular upper sloping portion 52*a* and the annular lower sloping portion 53*a* are connected with each other through the small rounded smallest diameter portion 51*a*. An angle Sa between the annular upper sloping portion (or a first imaginary plane which is obtained by extending the annular upper sloping portion and is shown as an imaginary line La in FIG. 22) and the annular lower sloping portion (or a second imaginary plane which is obtained by extending the annular lower sloping portion and is shown as an imaginary line Na in FIG. 22) is an acute angle. Specifically, the above-described angle Sa is preferably 30° to 90°, particularly preferably, 45° to 75°.

Since the portions forming a groove to have such an angle therebetween are formed, when the tip-side sealing portion 3*b* is twisted, a sufficiently large stress acts on the breakable portion. Therefore, the breakable portion can be broken easily.

An angle Ra is formed between the first imaginary plane (the imaginary line) La obtained by extending the annular upper sloping portion and an imaginary annular horizontal plane (horizontal line) Ma at an intersection P between the first imaginary plane (the imaginary line) La and the second imaginary plane (the imaginary line) Na obtained by extending the annular lower sloping portion. The angle Ra is preferably is 15° to 75°, particularly preferably, 30° to 60°.

The drug-filled synthetic resin ampule 1*b* of the present embodiment also includes a tip-side sealing portion whose shape is approximately the same as the drug-filled synthetic resin ampule 1 of the above-described embodiment.

The tip-side sealing portion 3*b* of the drug-filled synthetic resin ampule 1*b* of the present embodiment differs from the tip-side sealing portion 3 of the above-described drug-filled synthetic resin ampule 1 only in the point that the tip-side sealing portion 3*b* has a recess 41 formed at a top portion thereof.

Figure 18:
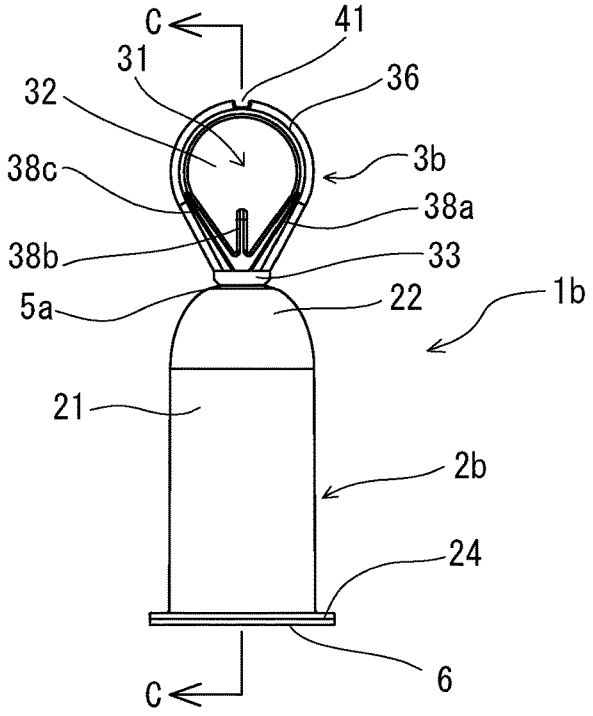
FIG. 18 is a front view of a drug-filled synthetic resin ampule of still another embodiment of the present invention.
Figure 19:
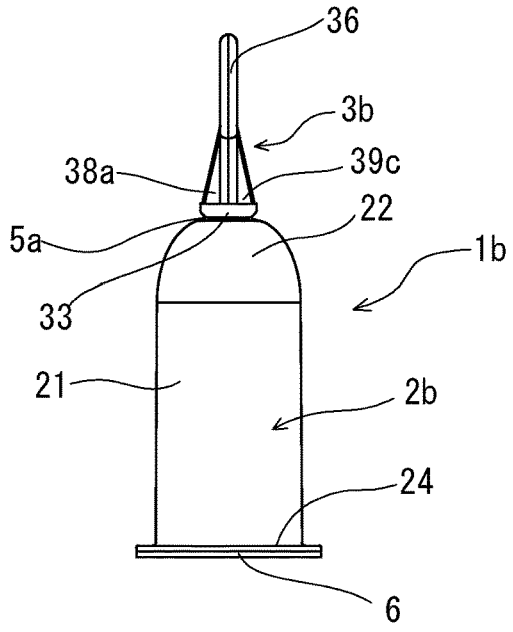
FIG. 19 is a right side view of the drug-filled synthetic resin ampule of FIG. 18.
Figure 20:
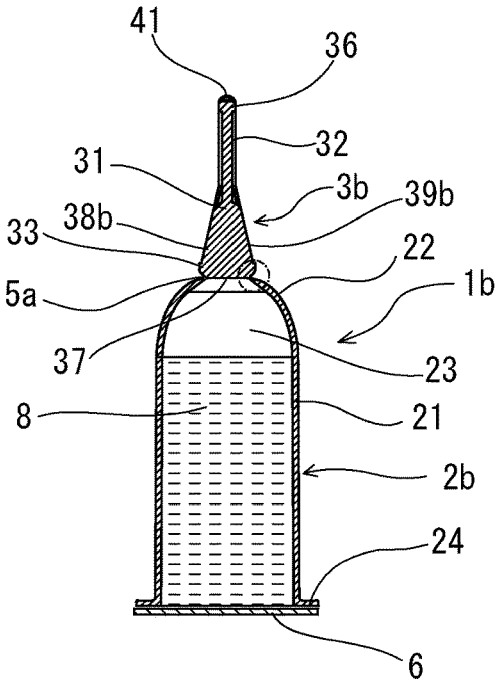
FIG. 20 is a sectional view taken along line C-C of FIG. 18.
Figure 21:
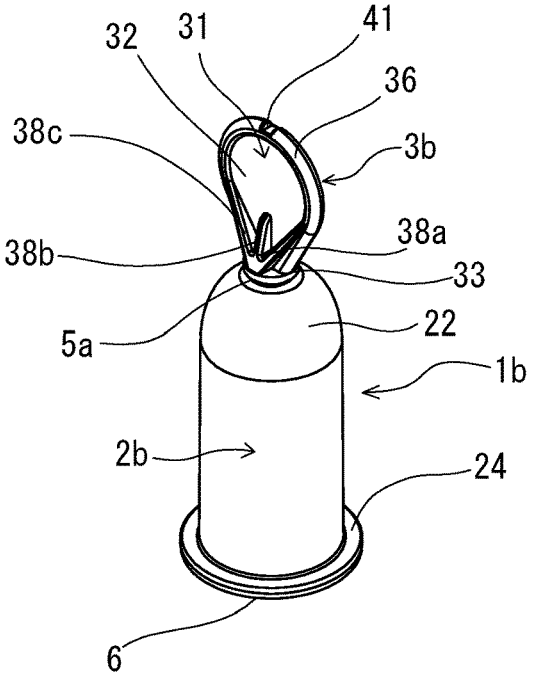
FIG. 21 is a perspective view of the drug-filled synthetic resin ampule of FIG. 18.

In the ampule 1*b* of the present embodiment, the tip-side sealing portion 3*b* has the base plate portion 31 and the flat plate portion for grasping 32 provided at an upper portion of the base plate portion 31. As shown in FIGS. 18 and 19, the flat plate portion for grasping 32 is flat on opposite sides so as to allow a user to easily grasp the opposite surfaces with his/her fingers. The flat plate portion for grasping 32 has, on the opposite sides, flat surfaces which do not have protrusions or the like.

Further, the ampule 1*b* has the bulging portion 36 provided at the circumferential edge of the flat plate portion for grasping 32; in other words, at the circumferential edge of an upper portion of the base plate portion 31. Therefore, when the user grasps the opposite sides of the flat plate portion for grasping 32 with his/her fingers, the fingers are less likely to slip; in other words, the grasped state can be maintained well. The bulging portion 36 also functions as a reinforcing portion for the base plate portion 31 of the tip-side sealing portion 3. Moreover, the ampule 1*b* has the recess 41 formed at the top portion of the bulging portion 36 (the top of the tip-side sealing portion 3*b*). The recess 41 does not reach the flat plate portion for grasping 32. Specifically, the recess 41 extends from the top portion of the bulging portion 36 and has a bottom portion near the center of the bulging portion 36 in the thickness direction thereof.

INDUSTRIAL APPLICABILITY

A drug-filled synthetic resin ampule according to the present invention is as follows.

(1) A drug-filled synthetic resin ampule comprising a hollow ampule body, a lower-end-side sealing member for sealing a lower end of the ampule body, and a drug filled in the ampule body;

wherein the ampule body includes a tip-side sealing portion, a hollow portion located below the tip-side sealing portion and having a drug containing portion therein, and an annular breakable portion provided between a lower portion of the tip-side sealing portion and an upper portion of the hollow portion;

the tip-side sealing portion includes a flat plate portion for grasping formed at an upper portion thereof and an internal ceiling portion exposed to an interior of the hollow portion; and the breakable portion includes an annular smallest diameter portion which is located near an annular circumferential edge portion of the internal ceiling portion and is located above the annular circumferential edge portion of the internal ceiling portion.

In the drug-filled synthetic resin ampule, since the tip-side sealing portion has a flat plate portion for grasping formed at an upper portion thereof, the twisting operation is easy. The smallest diameter portion of the breakable portion is located near the annular circumferential edge portion of the internal ceiling portion, and is located above the annular circumferential edge portion of the internal ceiling portion. Therefore, the ampule can be broken well by the twisting operation.

Also, the drug-filled synthetic resin ampule may be embodied as follows.

(2) A drug-filled synthetic resin ampule according to the above (1), wherein the annular smallest diameter portion is an annular smallest diameter portion formed to have an acute angle.

(3) A drug-filled synthetic resin ampule according to the above (1) or (2), wherein an upper portion of the hollow portion gradually decreases in wall thickness toward the smallest diameter portion of the breakable portion.

(4) A drug-filled synthetic resin ampule according to any one of the above (1) through (3), wherein the ampule is broken at the breakable portion as a result of the flat plate portion for grasping of the tip-side sealing portion being grasped and twisted.

(5) A drug-filled synthetic resin ampule according to any one of the above (1) through (4), wherein the ampule body includes a bottom plate member for sealing a lower end opening of the hollow portion.

(6) A drug-filled synthetic resin ampule according to any one of the above (1) through (5), wherein the ampule body is formed of a hard or semi-hard synthetic resin material through injection molding.

(7) A drug-filled synthetic resin ampule according to any one of the above (1) through (6), wherein the annular smallest diameter portion is an annular smallest diameter portion formed to have an acute angle, and the breakable portion has an angle of 30° to 90° at the smallest diameter portion.

(8) A drug-filled synthetic resin ampule according to any one of the above (1) through (7), wherein the breakable portion includes an annular upper sloping portion extending upward from the smallest diameter portion and an annular lower sloping portion extending downward from the smallest diameter portion, and an angle between the annular upper sloping portion and the annular lower sloping portion is 45° to 75°.

(9) A drug-filled synthetic resin ampule according to any one of the above (1) through (8), wherein the breakable portion has an annular upper sloping portion extending upward from the smallest diameter portion, and an angle between the annular upper sloping portion and a horizontal line passing through an imaginary annular plane formed by the smallest diameter portion is 15° to 75°.

(10) A drug-filled synthetic resin ampule according to any one of the above (1) through (9), wherein a corner portion of the internal ceiling portion has an edge-free curved surface.

(11) A drug-filled synthetic resin ampule according to any one of the above (1) through (10), wherein the tip-side sealing portion includes a reinforcing portion which extends upward from a lower portion of the tip-side sealing portion and ends at a lower end portion of the flat plate portion for grasping.

A synthetic resin ampule body for a drug-filled ampule according to the present invention is as follows.

(12) A synthetic resin ampule body for a drug-filled ampule, comprising a tip-side sealing portion, a hollow portion having a drug containing portion, and an annular breakable portion provided between a lower portion of the tip-side sealing portion and an upper portion of the hollow portion;

wherein the breakable portion includes an annular smallest diameter portion, and the tip-side sealing portion includes a flat plate portion for grasping formed at an upper portion thereof and an internal ceiling portion exposed to an interior of the hollow portion; and the smallest diameter portion of the breakable portion is located near an annular circumferential edge portion of the internal ceiling portion and is located above the annular circumferential edge portion of the internal ceiling portion.

(13) A synthetic resin ampule body for a drug-filled ampule according to the above (12), wherein the annular smallest diameter portion is an annular smallest diameter portion formed to have an acute angle.

(14) A synthetic resin ampule body for a drug-filled ampule according to the above (12) or (13), wherein the ampule is broken at the breakable portion as a result of the flat plate portion for grasping of the tip-side sealing portion being grasped and twisted.

(15) A synthetic resin ampule body for a drug-filled ampule according to any one of the above (12) through (14), wherein the ampule body is formed of a hard or semi-hard synthetic resin material through injection molding.

(16) A synthetic resin ampule body for a drug-filled ampule according to any one of the above (12) through (15), wherein the tip-side sealing portion includes a reinforcing portion which extends upward from a lower portion of the tip-side sealing portion and ends at a lower end portion of the flat plate portion for grasping.

(17) A synthetic resin ampule body for a drug-filled ampule according to any one of the above (12) through (16), wherein the breakable portion includes an annular upper sloping portion extending upward from the smallest diameter portion and an annular lower sloping portion extending downward from the smallest diameter portion, and an angle between the annular upper sloping portion and the annular lower sloping portion is 45° to 75°.

The invention claimed is:

1. A drug-filled synthetic resin ampule comprising a hollow ampule body, a lower-end-side sealing member for sealing a lower end of the hollow ampule body, and a drug filled in the hollow ampule body;

wherein the hollow ampule body includes a tip-side sealing portion, a hollow portion located below the tip-side sealing portion and having a drug containing portion therein, and an annular breakable portion provided at a lower portion of the tip-side sealing portion;

the tip-side sealing portion includes a flat plate portion for grasping formed at an upper portion thereof and an internal ceiling portion exposed to an interior of the hollow portion;

the annular breakable portion includes an annular smallest diameter portion which is located near an annular circumferential edge portion of the internal ceiling portion and is located above the annular circumferential edge portion of the internal ceiling portion;

the internal ceiling portion has a flat portion located radially inward of the annular circumferential edge portion and below the annular breakable portion;

the hollow ampule body has a diameter reducing portion that reduces in outer and inner diameter toward the annular breakable portion; and the annular breakable portion has a thin weak portion located at an upper end portion of said diameter reducing portion and located between the annular smallest diameter portion and the annular circumferential edge portion.

2. A drug-filled synthetic resin ampule according to claim 1, wherein the annular smallest diameter portion is an annular smallest diameter portion formed to have an acute angle.

3. A drug-filled synthetic resin ampule according to claim 1, wherein an upper portion of the hollow portion gradually decreases in wall thickness toward the smallest diameter portion of the annular breakable portion.

4. A drug-filled synthetic resin ampule according to claim 1, wherein the ampule is broken at the annular breakable portion as a result of the flat plate portion for grasping of the tip-side sealing portion being grasped and twisted.

5. A drug-filled synthetic resin ampule according to claim 1, wherein the hollow ampule body includes a bottom plate member for sealing a lower end opening of the hollow portion.

6. A drug-filled synthetic resin ampule according to claim 1, wherein the hollow ampule body is formed of a hard or semi-hard synthetic resin material through injection molding.

7. A drug-filled synthetic resin ampule according to claim 1, wherein the annular smallest diameter portion is an annular smallest diameter portion formed to have an acute angle, and the annular breakable portion has an angle of 30° to 90° at the smallest diameter portion.

8. A drug-filled synthetic resin ampule according to claim 1, wherein the annular breakable portion includes an annular upper sloping portion extending upward from the smallest diameter portion and an annular lower sloping portion extending downward from the smallest diameter portion, and an angle between the annular upper sloping portion and the annular lower sloping portion is 45° to 75°.

9. A drug-filled synthetic resin ampule according to claim 1, wherein the annular breakable portion has an annular upper sloping portion extending upward from the smallest diameter portion, and an angle between the annular upper sloping portion and a horizontal line passing through an imaginary annular plane formed by the smallest diameter portion is 15° to 75°.

10. A drug-filled synthetic resin ampule according to claim 1, wherein a corner portion of the internal ceiling portion has an edge-free curved surface.

11. A drug-filled synthetic resin ampule according to claim 1, wherein the tip-side sealing portion includes a reinforcing portion which extends upward from a lower portion of the tip-side sealing portion and ends at a lower end portion of the flat plate portion for grasping.

12. A drug-filled synthetic resin ampule according to claim 1, wherein the annular smallest diameter portion has a cross section having the shape of a short arc.

13. A synthetic resin ampule body for a drug-filled ampule, comprising a tip-side sealing portion, a hollow portion having a drug containing portion, and an annular breakable portion provided at a lower portion of the tip-side sealing portion;

wherein the annular breakable portion includes an annular smallest diameter portion, and the tip-side sealing portion includes a flat plate portion for grasping formed at an upper portion thereof and an internal ceiling portion exposed to an interior of the hollow portion;

the smallest diameter portion of the annular breakable portion is located near an annular circumferential edge portion of the internal ceiling portion and is located above the annular circumferential edge portion of the internal ceiling portion;

the internal ceiling portion has a flat portion located radially inward of the annular circumferential edge portion and below the annular breakable portion;

the hollow ampule body has a diameter reducing portion that reduces in outer and inner diameter toward the annular breakable portion; and the annular breakable portion has a thin weak portion located at an upper end portion of said diameter reducing portion and located between the annular smallest diameter portion and the annular circumferential edge portion.

14. A synthetic resin ampule body for a drug-filled ampule according to claim 13, wherein the annular smallest diameter portion is an annular smallest diameter portion formed to have an acute angle.

15. A synthetic resin ampule body for a drug-filled ampule according to claim 13, wherein the ampule is broken at the annular breakable portion as a result of the flat plate portion for grasping of the tip-side sealing portion being grasped and twisted.

16. A synthetic resin ampule body for a drug-filled ampule according to claim 13, wherein the synthetic resin ampule body is formed of a hard or semi-hard synthetic resin material through injection molding.

17. A synthetic resin ampule body for a drug-filled ampule according to claim 13, wherein the tip-side sealing portion includes a reinforcing portion which extends upward from a lower portion of the tip-side sealing portion and ends at a lower end portion of the flat plate portion for grasping.

18. A synthetic resin ampule body for a drug-filled ampule according to claim 13, wherein the annular breakable portion includes an annular upper sloping portion extending upward from the smallest diameter portion and an annular lower sloping portion extending downward from the smallest diameter portion, and an angle between the annular upper sloping portion and the annular lower sloping portion is 45° to 75°.

19. A synthetic resin ampule body for a drug-filled ampule according to claim 13, wherein the annular smallest diameter portion has a cross section having the shape of a short arc.

20. A drug-filled synthetic resin ampule comprising a hollow ampule body, a lower-end-side sealing member for sealing a lower end of the hollow ampule body, and a drug filled in the hollow ampule body;

wherein the hollow ampule body includes a tip-side sealing portion, a hollow portion located below the tip-side sealing portion and having a drug containing portion therein, and an annular breakable portion provided at a lower portion of the tip-side sealing portion;

the tip-side sealing portion includes a flat plate portion for grasping formed at an upper portion thereof and an internal ceiling portion exposed to an interior of the hollow portion;

the annular breakable portion includes an annular smallest diameter portion which is located near an annular circumferential edge portion of the internal ceiling portion and is located above the annular circumferential edge portion of the internal ceiling portion, an upper portion of the hollow portion gradually decreases in wall thickness toward the smallest diameter portion of the annular breakable portion, the annular breakable portion includes an annular upper sloping portion extending upward from the smallest diameter portion and an annular lower sloping portion extending downward from the smallest diameter portion, and an angle between the annular upper sloping portion and the annular lower sloping portion is 45° to 75°, the internal ceiling portion has a flat portion located radially inward of the annular circumferential edge portion and below the annular breakable portion, the hollow ampule body has a diameter reducing portion that reduces in outer and inner diameter toward the annular breakable portion, and the annular breakable portion has a thin weak portion located at an upper end portion of said diameter reducing portion and located between the annular smallest diameter portion and the annular circumferential edge portion.

* * * * *